United States Patent [19]

Remmers

[11] Patent Number: 4,735,325

[45] Date of Patent: Apr. 5, 1988

[54] SUPPORT CLIP

[75] Inventor: Lee Remmers, Ocala, Fla.

[73] Assignee: Clairson International, Ocala, Fla.

[21] Appl. No.: 872,939

[22] Filed: Jun. 11, 1986

[51] Int. Cl.[4] ..... A47B 47/00

[52] U.S. Cl. ..... 211/187; 211/90; 211/107; 248/250

[58] Field of Search ..... 211/187, 90, 107, 208; 248/239, 250, 221.3, 224.4, 231.9; 24/545, 555

[56] References Cited

U.S. PATENT DOCUMENTS

| | | | |
|---|---|---|---|
| 3,352,431 | 11/1967 | Smith | 211/208 |
| 4,032,096 | 6/1977 | Perrault et al. | 248/224.4 X |
| 4,283,035 | 8/1981 | Ojembarrena et al. | 248/265 X |
| 4,361,099 | 11/1982 | Kokenge et al. | 248/250 X |
| 4,534,530 | 8/1985 | Danko | 248/239 |
| 4,548,327 | 10/1985 | Kilkelly | 248/250 X |

*Primary Examiner*—Ramon S. Britts
*Assistant Examiner*—Blair M. Johnson
*Attorney, Agent, or Firm*—Cushman, Darby & Cushman

[57] ABSTRACT

A support clip for use with shelving, particularly open wire type shelving, that will permit the shelving to be pivoted through a vertical arc but which otherwise stabilizes and limits horizontal movement. The clip is provided with a compound opening area to receive in a snap-fit fashion and allow the pivotal movement of a straight wire portion of the side support wires of the wire shelving. The clip is mounted on a vertical support post and the rear face of the clip is designed to fit around and engage that vertical post. With such a clip adjacent the four corners of a shelf and secured to four vertical support posts (two front and two rear posts), the shelf is pivotal relative to the posts which will allow the shelf and the front posts to be moved through an upward arc toward the rear posts thus folding the shelf.

9 Claims, 3 Drawing Sheets

Fig. 1.
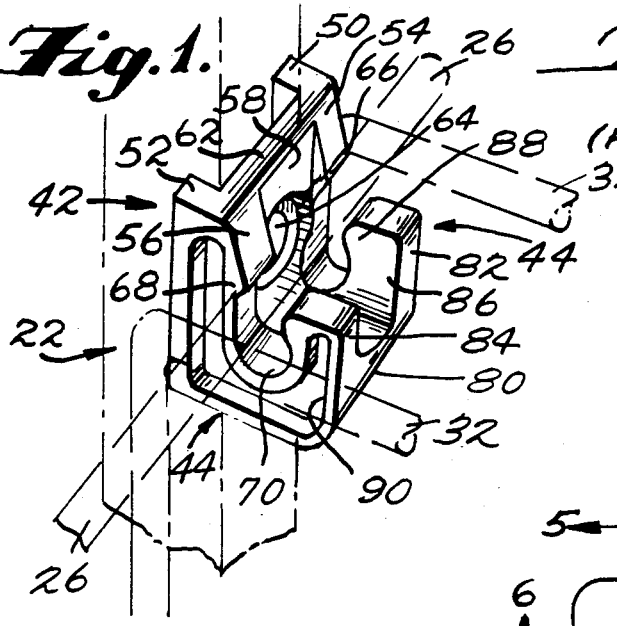
Fig. 1a.
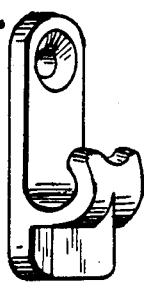
(PRIOR ART)
Fig. 3.
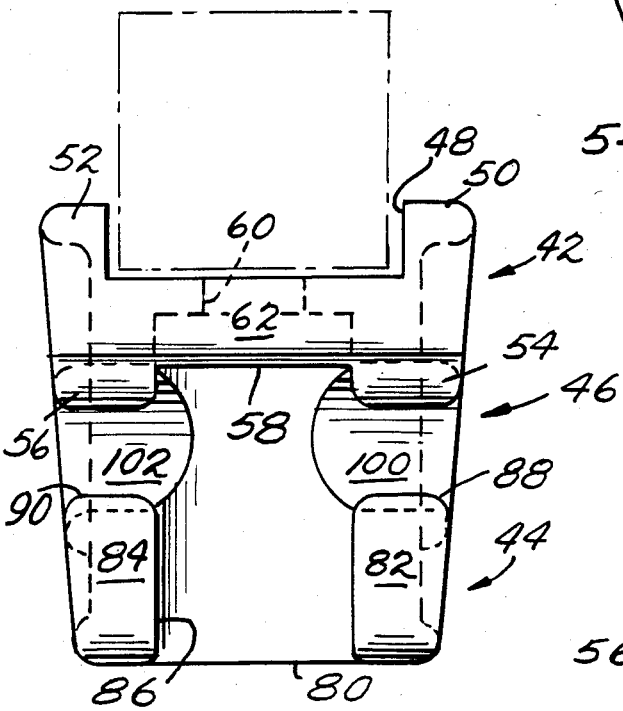
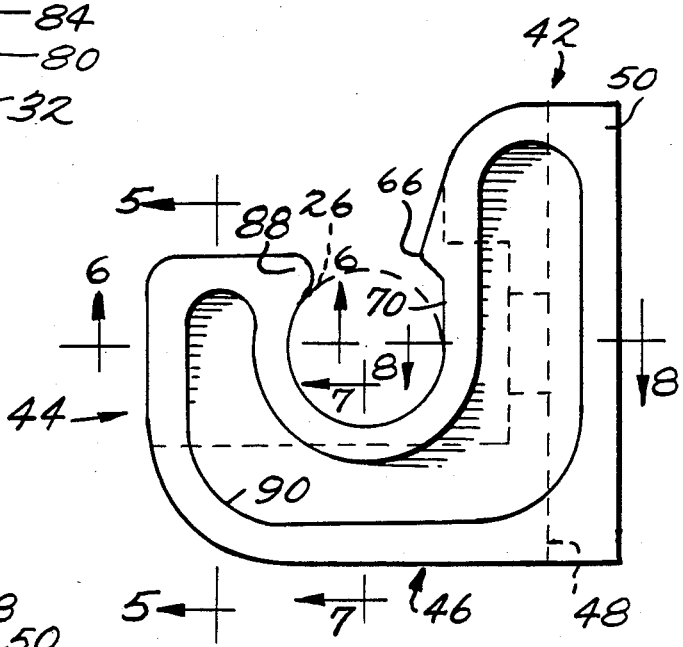
Fig. 2.
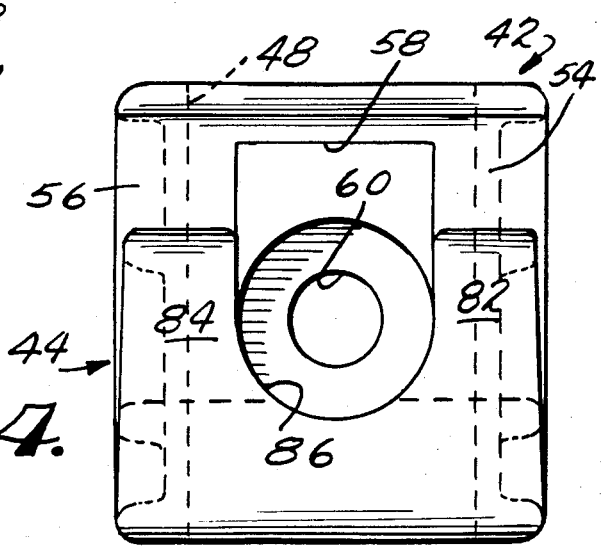
Fig. 4.

SUPPORT CLIP

FIELD OF THE INVENTION

The present invention relates to a support clip, for use in mounting wire shelving to support posts of a folding shelving system that provides a pivot connection therebetween and stabilizes the folding shelving system structure.

BACKGROUND OF THE PRESENT INVENTION

The present invention relates to a shelving system and, in fact, to a modified and improved clip device for use therewith. With regard to wire shelving, attention is directed to U.S. Pat. Nos. 3,598,064 and 3,765,634 to Stempel. Reference is also made to a co-pending design application for a somewhat similar folding shelf system, U.S. patent application, Ser. No. 705,502. In that design arrangement, the horizontal edge wires adjacent front and rear corners of the shelf extend outwardly beyond the main body of the shelf. These edge wire extensions pass through openings provided in front and rear pairs of support posts and directly provide the means for both shelf support on the posts and for relative pivoting therebetween.

That folding shelving system was subsequently modified by removing the edge wire extensions and by using a support clip as in FIG. 1*a*. Such a clip was mounted on the front face of the rear posts and the rear face of the front posts and the clip had a width less than the width of the post. The clip had a general J-shape, as shown, with the upwardly extending opening receiving a portion of the horizontal edge wires on the front and rear sides of the shelf. This clip, however, while suitable to provide vertical support for the shelf and for permitting pivoting of the shelf relative to the posts, the clip did not hold the edge wire within the opening nor did it provide sufficient stability for the shelf, either when the shelf system was folded in an upright, flat position against a wall, as when the rear posts themselves were attached to wall, or when unfolded with the front posts in contact with the floor.

Reference is also made to another co-pending, commonly assigned application, Ser. No. 714,445, dealing with a support clip in the form of an upwardly opening hook which extends outwardly from a rear planar body portion. That planar portion includes a resilient tab or finger integrally formed thereon to retain the edge wire of a rack or shelf and the top rear portion of the hook includes a rearwardly extending protrusion to cooperate with the resilient tab to help hold the edge wire in the hook.

Other folding shelves or racks of which the applicant is familiar are set forth in McKenzie, U.S. Pat. No. 253,081, Allen, U.S. Pat. No. 538,145, Arnold, U.S. Pat. No. 1,109,953, Cady, U.S. Pat. No. 1,727,048, Magnuson, U.S. Pat. No. 2,305,629, and Kilkelly, U.S. Pat. No. 4,548,327.

McKenzie discloses a clothes rack that has a pair of rear supports mounted to a wall and a pair of movable front supports connected to the rear supports by horizontal or transverse rods pivotally supported to both the back and front members by a pin as well as a series of longitudinal bars spanning across the front supports and between.

Allen discloses a free standing display rack comprised of four vertical posts with four spaced apart shelves vertically stacked therebetween. The corner posts are pivotally connected to the ends of the side edges of the shelves by bolts or screws, with the system also including bracing bar on each side of the device.

Arnold shows a collapsible wall mounted rack in the form of a plurality of separate arms, one end of which is pivotally connected to a plate attached to a wall. The other end of each arm is pivotally attached to a separate plate so that the arms, as a unit, can pivot toward and away from the wall. The rack also includes a brace member for holding the rack in its opened position. Each of the pivot connections is in the form of a simple hinge.

Cady discloses a free standing folding shelf arrangement where the vertical support posts are pivotally connected to a series of shelves. The connection therebetween is provided by a rod that passes along the front and rear edge of the shelf and through each of the vertical posts with a screw cap clamping the rod and posts together.

Magnuson concerns a collapsible wall mounted wardrobe rack having a plurality of shelves pivotally connected to front and rear vertical support members, the rear members being connected to a wall. The pivot connection is provided by a rivet or a bolt that passes through the vertical supports and the side member of the shelf.

Kilkelly shows a closet shelving system which includes J-shaped clips for mounting shelving to a stationary post or directly to a wall. Some of the clips are similar to that shown in FIG. 1*a* and one embodiment shown in FIG. 4 includes a flexible, resilient fin positioned so as to overlie the recess formed in the clip and retain the edge rod of a shelf in the recess of the clip.

SUMMARY OF THE PRESENT INVENTION

The present invention relates to an improved clip device for use in supporting a metal wire shelf, and in particular, to pairs of front and rear support posts. The clip device is a one-piece molded unit that includes a rear face shaped to receive and extend about a portion of the post with which it is used. The clip structure additionally includes an integral snap fit mechanism between spaced apart front and rear portions that define between them an upwardly opening recess for receiving the horizontal support or edge wire of wire shelving. The front and rear sections are joined together by an integral bottom portion. These three structural portions also provide two horizontally spaced apart surfaces for supporting the edge wire. The combination of the pair of horizontally spaced apart supporting surfaces, together with the rear opening that extends about the support post and the snap-fit retention of the edge wire within the shaped opening cooperate to provide a very stable support for the shelf, with respect to horizontal or sideways movement. This structure simulanteously permits the shelf to pivot through a vertical arc to thereby define closed and open positions for the folding shelving system.

Other objects, features, and characteristics of the present invention, as well as the methods and operation and functions of the related elements of the structure, and to the combination of parts and economies of their manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 1 is a perspective view of the support clip according to the present invention showing, in phantom, a portion of a support post and of a wire shelf;

FIG. 1*a* is showing of a previously used support clip;

FIG. 2 is a side, elevational view of the support clip according to the present invention;

FIG. 3 is a top, plan view of the support clip with a support post being shown in phantom;

FIG. 4 is a front, elevational view of the support clip;

DETAIL DESCRIPTION OF THE DRAWINGS

Figure 11:
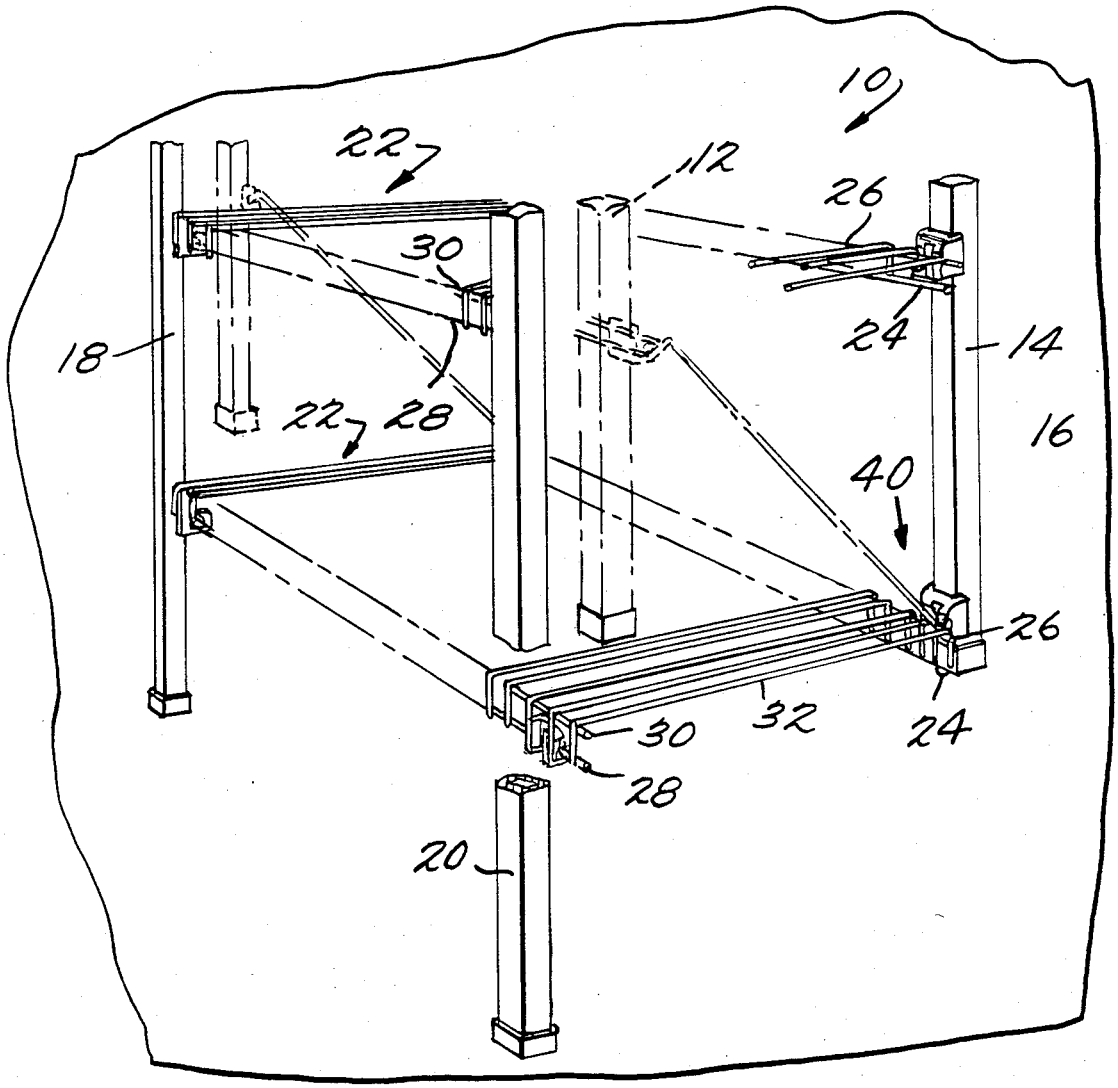
FIG. 11 is a diagrammatic showing of a shelf system incorporating the support clips according to the present invention.

Turning first to FIGS. 1 and 11, a folding shelf system is generally shown in FIG. 11 at 10, and is comprised of a pair of rear, vertical support posts 12 and 14 suitably affixed to a wall, generally indicated at 16 either by screws, bolts or any other convenient method. The shelf system also includes a pair of front support posts 18 and 20 and a series of wire shelves, generally indicated at 22, pivotally attached to each of the front and rear posts and spaced vertically from one another. A fragmented view of the shelving system is shown in FIG. 1, with specific reference being made to one clip and a single rear post 14. The relationship between the other posts and clips will be the same and, accordingly, each will not be specifically discussed.

Each shelf 22 is preferably comprised of a pair of vertically spaced apart rear edge or support wires 24 and 26, with 24 being the lower wire and 26 being the upper wire in that group. Similarly, the front of the shelf includes two vertically spaced apart edge wires 28 and 30 with 28 being the lower of the two wires. In addition, there are a plurality of horizontally spaced apart and horizontally extending deck wires 32 that extend across the shelf from front to rear parallel to the sides of the shelf. These deck wires are bent over and across each of the pairs of front and rear edge wires 24, 26/28, 30. All of the shelving wires are welded together at the crossing junctions and the shelving can include additional support wires extending either down the central portion of the shelf parallel to the front and rear edge wires or along the sides of the shelving. This form of shelving can be referred to as double lip decking. It should also be understood that each shelf could be comprised of only a single front and rear edge wire.

As shown in FIGS. 1 and 11, each shelf is pivotally supported on each of the support posts by a support clip, generally indicated at 40.

With reference to FIGS. 1–4, each support clip 40 is generally comprised of a rear portion 42, a front portion 44 and a connecting bottom portion 46. These three portions are all formed together as an integral unit, preferably by injection molding techniques, although other forming techniques could be used. It is preferred to manufacture the support clip from a plastic material, including but not limited to thermoplastic and/or thermoset materials, with the preferable material being nylon 6. However, other materials, including metals, could also be used.

Figure 5:
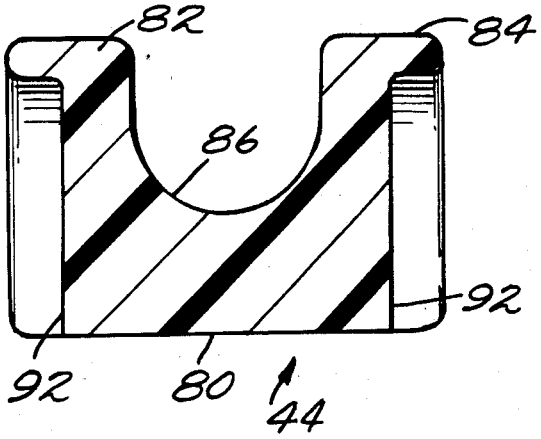
FIG. 5 is a cross-section taken along lines 5—5 of FIG. 2.
Figure 6:
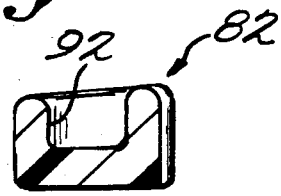
FIG. 6 is a cross-section taken along lines 6—6 of FIG. 2.
Figure 7:
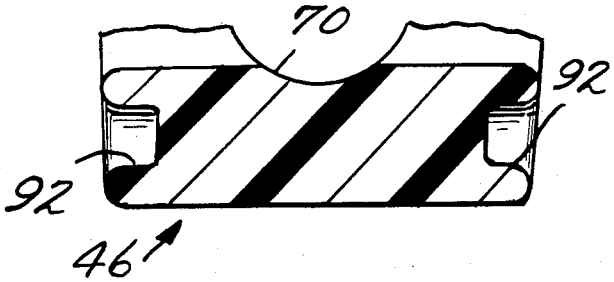
FIG. 7 is a cross-section taken along lines 7—7 of FIG. 2.
Figure 8:
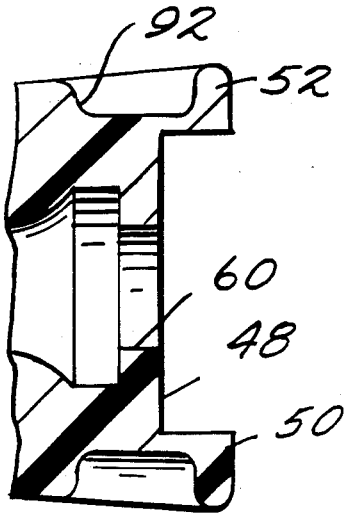
FIG. 8 is a cross-section taken along lines 8—8 of FIG. 2.
Figure 9:
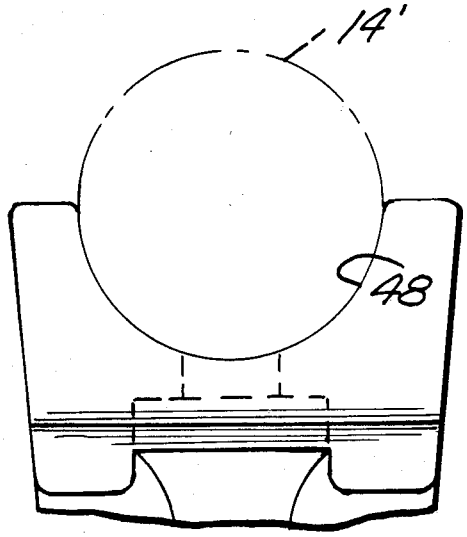
FIG. 9 is a top, plan view of another embodiment of the support clip according to the present invention showing a round post.

The rear portion 42 is formed with a rearwardly facing open channel 48 which extends along the full height of the rear portion. Channel 48 is defined between two rearwardly extending projections 50 and 52 with the width of channel 48, between projections 50 and 52, being equal to the outer dimension of the support posts, such as post 14, as shown in phantom in FIG. 3. Because of this, channel 48 will snugly fit over the post and will have a snug relationship to and about each post when fastened thereto by a screw that can fit through an opening 60. Should the posts be circular, channel 48 would be formed in a complimentary manner as shown for channel 48′ in another embodiment in FIG. 9 where channel 48′ extends around a substantial portion of the circular post 14′. What is important, however, is that this rearward channel fit over and securely engage the outer dimension of the support post. Each clip will then be held in place by a screw or other suit fastening device as shown at 64 in FIG. 1.

The front surface of rear portion 42 is also shaped by two horizontally spaced apart, forwardly extending projections 54 and 56 which define between them an indented recess area 58 such that a wall 62 is defined between recess 58 and channel 48. A mounting hole, generally indicated at 60, is provided so as to extend through wall portion 62 from the front side of indentation 58 into channel 48. Through hole 60, a suitable mounting screw or bolt 64 will be placed in order to mount clip 40 to the vertical post.

Projections 54 and 56 are each provided with a frontwise extending protuberance, as at 66 and 68 respectively, in FIG. 1, which will cooperate with a complimentary portion on the front portion, discussed below, to provide the desired pivot connection, as well as a snap fit for the shelf edge wire. These members will also act as a retainer for the edge wire held therein, such as, for example, edge wire 26 as shown in FIGS. 1 and 2. The surface extending downwardly away from protubernaces 66 and 68 can be either a straight surface, or be gently curved to form the rear part of a circular recess 70 in which edge wire 26 is received in the bottom portion 46. The front surface extending upwardly away from protuberances 66 and 68 is preferably flat and angled at about 15° away from vertical.

The front portion 44 is comprised of a bottom horizontal wall portion 80, from which two spaced apart, upstanding fingers 82 and 84 extend, so that together they define a U-shaped opening 86 therebetween. This opening and the spacing between fingers 82/84 is preferably about 0.343 inches. The top of fingers 82 and 84 can be formed as a flat surface, or with a gentle curve. The rear surfaces of fingers 82 and 84 complete recess 70 and are preferably in the form of a curved surface as shown in FIG. 2. The top portion of the rear face of each of fingers 82 and 84 is comprised of a rearwardly extending protuberance 88 and 90 which cooperate with protuberances 66 and 68 to retain the wire 26 within the shaped recess 70 and provide the initial snap-fit of edge wire 26 therein. It should be understood that these protuberances are positioned above the bottom of recess 70 a sufficient distance to extend over or about edge wire 26 and will serve to hold it in place within recess 70 once that wire has been snapped into that recess, beyond those two sets of protuberances. The lower surfaces of protuberances 88 and 90 will most ideally engage the adjacent outer surface of the edge wire once the latter is in place, as shown in phantom in FIGS. 1 and 2. The lower surfaces of protuberances 66 and 68, on the other hand, are positioned slightly above the outer surface of edge wire 26 to define a small gap therebetween. However, in other respects, edge wire 26 is substantially enclosed by the interior surfaces of recess 70 and is positioned against the lower portions of projections 54 and 56 by reason of the engagement developed between the lower surfaces of protrusions 88 and 90 as well as the remaining surfaces of recess 70. The dimension across recess 70 will preferably be equal to or just slightly greater than the diameter of the edge wire to be held therein so that the edge wire will be pivotable therein yet snugly retained.

Each exterior side wall of clip 40 can be provided with a shaped recess or undercut reinforcing channel, generally indicated at 90, that extends along the clip profile from the sides of legs 82, 84 in the front portion 44 through bottom portion 46 and up into the area of the rearward projections 50, 52.

With reference to FIGS. 2, 3 and 4, while recess 70, defined by and between the front surfaces of projections 54 and 56 and the rear surfaces of fingers 82 and 84 as well as the upper exposed surface of the connecting bottom portion 46 extends across the full width of clip 40 it, in fact, is comprised of two horizontally spaced apart support surfaces 100 and 102 which together define the bottom of recess 70 on which the edge wire is supported. The spaced apart surfaces 100 and 102 are spaced apart, as shown in FIG. 3, together with projections 54 and 56 and fingers 82 and 84, combine to form two spaced apart gripping and support areas within the support clip for the edge wire held therein. This provides two separate support locations within a single clip and, accordingly, increases the stability of the available support. Accordingly, support clip 40, through the use of the post engaging channel and the pair of spaced apart edge wire supports, establishes a solid shelf-to-post connection and provides a very stable folding shelf structure that will permit pivoting of the front legs and the shelves through a vertical arc yet substantially reduces if not eliminates side to side swaying of the folding shelving system.

The support clip 40 preferably has a height of the rear portion of about 0.8 inches (0.784) with a width of about 0.76 inches and a diameter of recess 70 of approximately 0.270±0.005 inches. The dimension from front to rear, that is from the front of fingers 82, 84 to the rear surface of projections 50, 52 can be about 0.814 inches. Channel 48 preferably has a width of about 0.510 inches ±0.005 inches, which is slightly greater than the width of the support posts. Accordingly, when each of the clips is secured in place about that post, channel 48 will be snuggly retained about that post, will not pivot relative to screw 64 and will provide a firm connection point between the post and shelf. Because of the dimensions of channel 48 relative to a post, and because projections 50 and 52 extend rearwardly along the side wall of the posts, the clip will remain very stable relative to the post on which it is mounted. Accordingly, this post/clip arrangement together with the presence of the two spaced apart surfaces 100 and 102, results in a firm and stable gripping of the support wire 26 and provides a very stable environment for that edge wire. Since this effect occurs at each shelf support point, the entire shelving system is rendered very stable and is not prone to swaying or sideways movements.

With reference again to FIG. 11, it should be noted that the rear posts are offset horizontally from the front posts, and this can occur in either direction. Thus, clips 40 at the front and rear of a shelf are preferably not positioned between the same two deck wires. The rear posts can be offset inboard of the front posts with the clips being appropriately positioned so that a pair of deck wires will lie between the locations where such clips are positioned. By offsetting the posts in this manner, the entire structure can be folded into an upright condition, where the deck wires 32 are vertical and extend parallel to each of the support posts, with the support posts being separated by the distance between the edge wires. However, it should be understood that a wide variety of various post and clip positioning arrangements relative to attached shelving are possible.

With respect to the double lip decking as shown in FIG. 11 where two edge wires are used, the rear support clips secured to posts 12 and 14 are positioned so as to engage the top or uppermost of the two edge wires, wire 26, to allow the shelf to pivot upwardly relative to the rear posts. In a complimentary fashion, the clips 40 on front posts 18 and 20 are located so that it is the bottommost edge wire 28 that is supported in those support clips. Should the shelves each have only a single front or rear edge wire, that is if they should include only wire 26 at the rear and only wire 30 along the front, then each of the support clips would operate with those single edge wires, respectively. It should also be understood, that deck wires 32 are all spaced apart at least a distance sufficient to permit clip 40 to be inserted therebetween although other spacings could be employed between wires where clips will not be used.

Figure 10:
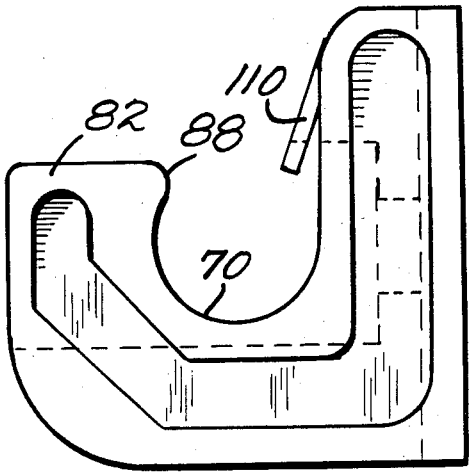
FIG. 10 is a diagrammatic, side elevational view of an additional embodiment of the support clip according to the present invention.

As an additional embodiment of the present invention, reference can be made to FIG. 10, wherein the clip has exactly the same structure as shown in the remaining FIGURES, except that rather than employing protuberances 66 and 68, a flexible and resilient flap 110 is provided on the modified form of the clip 40' as shown in FIG. 10 with this resilient flap 110 serving to provide a snap fit engagement of the edge rod 26 into opening 70' with flap 110 extending across the width of the rear section 42. Should that flap extend down sufficiently far to intersect opening 60 for an attaching screw, the central portion of that flap could contain an arched portion, axially coincident with the aperture 60 so that a screw could be received as well through that aperture.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A support clip for stabilizing and supporting open wire shelving having edge wires provided at least along front and rear edges of such shelving with the shelving being pivotally mounted to vertical supports, said clip comprised of a body having front and rear portions joined integrally together by a connecting bottom portion, said bottom portion having an upper surface and a front edge, said front, bottom and rear portion defining an upwardly opening area and means for releasibly receiving a portion of said edge wire therein in a snap-fit manner so that said edge wire can rotate therein, said front portion including a pair of spaced apart, upstanding fingers, each of said fingers extending upwardly from said upper surface of said bottom portion at said front edge, each said finger further having a rear surface that forms at least a portion of said upwardly opening area and including a protuberance at the upper end thereof for engaging said edge wire, each said upstanding finger having a height at least as great as the diameter of a said edge wire received in said upwardly opening area, said rear portion including a pair of spaced apart, forwardly extending members located opposite of said upstanding fingers which together form at least a portion of said upwardly opening area, said rear portion further including a rear face having a predetermined height and width, means defining a rearwardly opening channel in said rear face, said channel means occupying the full height of said rear face and having a width less than the full width of said rear face, said rear portion further including means for permitting attachment of said support clip to said vertical supports.

2. A support clip as in claim 1, wherein said rear portion further includes a pair of rearwardly extending wall members bounding and defining the sides of said channel means.

3. A support clip as in claim 1, wherein said releasably receiving means is comprised of opposing protuberances positioned on opposite sides of said upwardly opening area and above the bottom of said upwardly opening area by a distance at least equal to the diameter of the edge wire.

4. A support clip as in claim 1, wherein said bottom portion includes two spaced apart support surfaces which are in direct contact with said edge wire.

5. A support clip as in claim 1, wherein said support clip is formed as an integral one piece unit.

6. A support clip as in claim 1, wherein said support clip is formed by injection molding.

7. A support clip as in claim 1, wherein said support clip is comprised of a plastic material.

8. A support clip as in claim 7, wherein said plastic material is comprised of nylon.

9. In combination, a shelf assembly comprised of front and rear pairs of vertical support members, at least one shelf member having at least one edge wire provided along the front and rear edges thereof, and a plurality of support clips for connecting said shelf member to said front and rear pairs of vertical support members so that said shelf member can be pivoted with respect to each of said front and rear pairs of vertical support members, said support clips being comprised of a body having front and rear portions joined integrally together by a connecting bottom portion, said bottom portion having an upper surface and a front edge, said front, bottom and rear portions defining therebetween an upwardly opening area releasably receiving a portion of an edge wire therein in a snap-fit manner so that said edgewire and said shelf can rotate with respect thereto, said front portion including a pair of spaced apart, upstanding fingers, each of said fingers extending upwardly from said upper surface of said bottom portion at said front edge, each said finger having a rear surface that forms at least a portion of said upwardly opening area and including a protuberance at the upper end thereof for engaging said edge wire, each said upstanding finger having a height at least as great as the diameter of a said edge wire received in said upwardly opening area, said rear portion including a pair of spaced apart, forwardly extending members which together form at least a portion of said upwardly opening area, said rear portion further including means defining a rearwardly opening channel, said channel occupying a width less than the full width of said rear portion so that at least a portion of said rear portion projects rearwardly along each side of said channel, said rear portion further including means for permitting attachment of said support clip to said vertical support members.

* * * * *